US005894270A

United States Patent [19]

Clancy et al.

[11] Patent Number: 5,894,270

[45] Date of Patent: Apr. 13, 1999

[54] APPARATUS FOR THE SURVEILLANCE OF AN ELECTRONIC SECURITY ELEMENT IN AN INTERROGATION ZONE

[75] Inventors: Terry Clancy, Bensheim-Zell, Germany; David Stocks, Melbourn, United Kingdom

[73] Assignee: Esselte Meto International GmbH, Heppenheim, Germany

[21] Appl. No.: 08/941,286

[22] Filed: Sep. 30, 1997

[30] Foreign Application Priority Data

Oct. 29, 1996 [DE] Germany ..... 196 44 927

[51] Int. Cl.[6] ..... G08B 13/14

[52] U.S. Cl. ..... 340/572.4; 340/825.54

[58] Field of Search ..... 340/572, 825.54, 340/825.34, 572.4; 235/380

[56] References Cited

U.S. PATENT DOCUMENTS

| | | | |
|---|---|---|---|
| 4,168,496 | 9/1979 | Lichtblau | 340/572 |
| 4,459,474 | 7/1984 | Walton | 235/380 |
| 4,630,035 | 12/1986 | Stahl et al. | 340/539 |
| 4,668,942 | 5/1987 | Eccleston et al. | 340/572 X |
| 4,679,035 | 7/1987 | Pfaff et al. | 340/572 |
| 4,975,681 | 12/1990 | Watkins et al. | 340/572 |
| 5,023,598 | 6/1991 | Zemlok et al. | 340/572 |
| 5,300,922 | 4/1994 | Stoffer | 340/572 |
| 5,349,339 | 9/1994 | Kind | 340/572 |
| 5,450,492 | 9/1995 | Hook et al. | 340/572 X |
| 5,495,229 | 2/1996 | Balch et al. | 340/572 X |
| 5,557,085 | 9/1996 | Tyren et al. | 235/380 |
| 5,673,024 | 9/1997 | Frederick et al. | 340/572 |
| 5,699,045 | 12/1997 | Frederick et al. | 340/572 X |

FOREIGN PATENT DOCUMENTS

| | | |
|---|---|---|
| 0 186 304 | 3/1990 | European Pat. Off. . |
| 0 431 341 | 6/1991 | European Pat. Off. . |
| 0 565 481 | 10/1993 | European Pat. Off. . |
| 3624285 | 2/1987 | Germany . |
| 14474 | 7/1993 | WIPO . |

*Primary Examiner*—Thomas Mullen

*Attorney, Agent, or Firm*—Jones, Tullar & Cooper, P.C.

[57] ABSTRACT

The present invention relates to an apparatus for the surveillance of an electronic security element in an interrogation zone, comprising a transmitting device emitting at least one cyclic interrogation signal into the interrogation zone, with the interrogation signal causing the security element to deliver a characteristic signal, a receiving device receiving the characteristic signal, and a computing/control unit evaluating the signals received from the receive device and producing an alarm when the presence of the security element is established.

7 Claims, 2 Drawing Sheets

APPARATUS FOR THE SURVEILLANCE OF AN ELECTRONIC SECURITY ELEMENT IN AN INTERROGATION ZONE

BACKGROUND OF THE INVENTION

1. Technical Field

This invention relates to an apparatus for the surveillance of an electronic security element in an interrogation zone, more specifically to such an apparatus which has a transmitting device emitting at least one cyclic interrogation signal into the interrogation zone, with the interrogation signal causing the security element to deliver a characteristic signal, a receiving device which receives the characteristic signal, and a computing/control unit which evaluates the signals received from the receiving device and produces an alarm when the presence of the security element is established.

2. Background Art

To detect the presence of electromagnetic security elements in an interrogation zone, it is proposed in European patent, EP 123 586 B, to emit into the interrogation zone, in addition to two interrogation fields with the frequencies F1 and F2 in the kilohertz range, a field with a frequency F3 in the hertz range. The two interrogation fields with the frequencies F1 and F2 cause a security element present in the interrogation zone to emit a characteristic signal with the intermodulation frequencies n·F1±m·F2 (where n, m=0, 1, 2, . . . ). The low-frequency interrogation field causes the security element to be driven from saturation in one direction into saturation in the other direction at the clock rate of this particular field. As a result, the characteristic signal occurs cyclically at the frequency of the low-frequency field.

As an alternative solution, it has further become known to use only one interrogation field in the kilohertz range for excitation of the security element, with the characteristic signal of the security element occurring again at the clock rate of a low-frequency field cycling the magnetically soft, non-linear material between the two states of saturation.

Further, it has been known in the art to remove from the received signals interferences bearing a relation to the known frequency of the power supply or its harmonics, enabling the measuring accuracy of the surveillance apparatus to be materially increased. A suitable method is described, for example, in European patent EP 0 431 341 B1.

It is a disadvantage of hitherto known surveillance apparatus that they are only suitable for the elimination of interference signals with known frequencies. They fail in the presence of temporary cyclic interference signals which bear no relation to the frequency of the power supply. Such interference signals are, for example, produced by a switching power supply for a cash register.

SUMMARY OF THE INVENTION

It is an object of the present invention to provide an apparatus which improves the detection of articles equipped with electronically detectable security elements within an interrogation zone.

This object is accomplished in that a computing/control unit records the signals received during a predetermined time period, determines from the signals whether and at what cycle, if applicable, interference signals occur, and removes these interference signals from the received signals. This enables the apparatus of the present invention to eliminate, in addition to cyclically occurring interference signals of known origin, also cyclically occurring interference signals originating from unidentified sources.

According to an advantageous aspect of the apparatus of the present invention, the computing/control unit records during the predetermined time period tp at least k*n measured values, where n=1, 2, 3 . . . , and k is an integer number smaller than the number of received signals divided by n, determining from a comparison of first n measured values with succeeding n measured values whether cyclic interference signals occur within the k interval encompassing n measured values.

It has proven to be particularly suitable to have the computing/control unit determine the occurrence of cyclic signals via the sum of the absolute differences applying the following formula:

$$c(n)=\Sigma|r(n*k \ldots n*(k+1)-1)-r(n*(k+1) \ldots n*(k+2)-1)|$$

An advantageous further aspect of the apparatus of the present invention provides that the computing/control unit determine the cyclic interference signal from the lowest resulting difference c(n), when the difference c is lower than a predetermined maximum value $c_{max}$, expressed as a fraction of the average interference level. Advantageously, the computing/control unit calculates the initial average interference signal a(i) in which an averaged interference signal occurs via the k interval of n measured values using the following formula:

$$a(i)=\Sigma r(n*(k+i)), \text{ where } i=1, 2, \ldots, n-1.$$

The cyclic interference signal determined in this manner is then subtracted from the received signals.

In order to ensure that in the determination of interference signals as disclosed in the present invention, the computing/control unit has at all times the updated values of cyclically occurring interference signals available, the measured values are updated at a fixed time constant f*system cycle period.

The present invention will be described in more detail in the following with reference to the accompanying drawings.

DESCRIPTION OF THE PREFERRED EMBODIMENT

Figure 1:
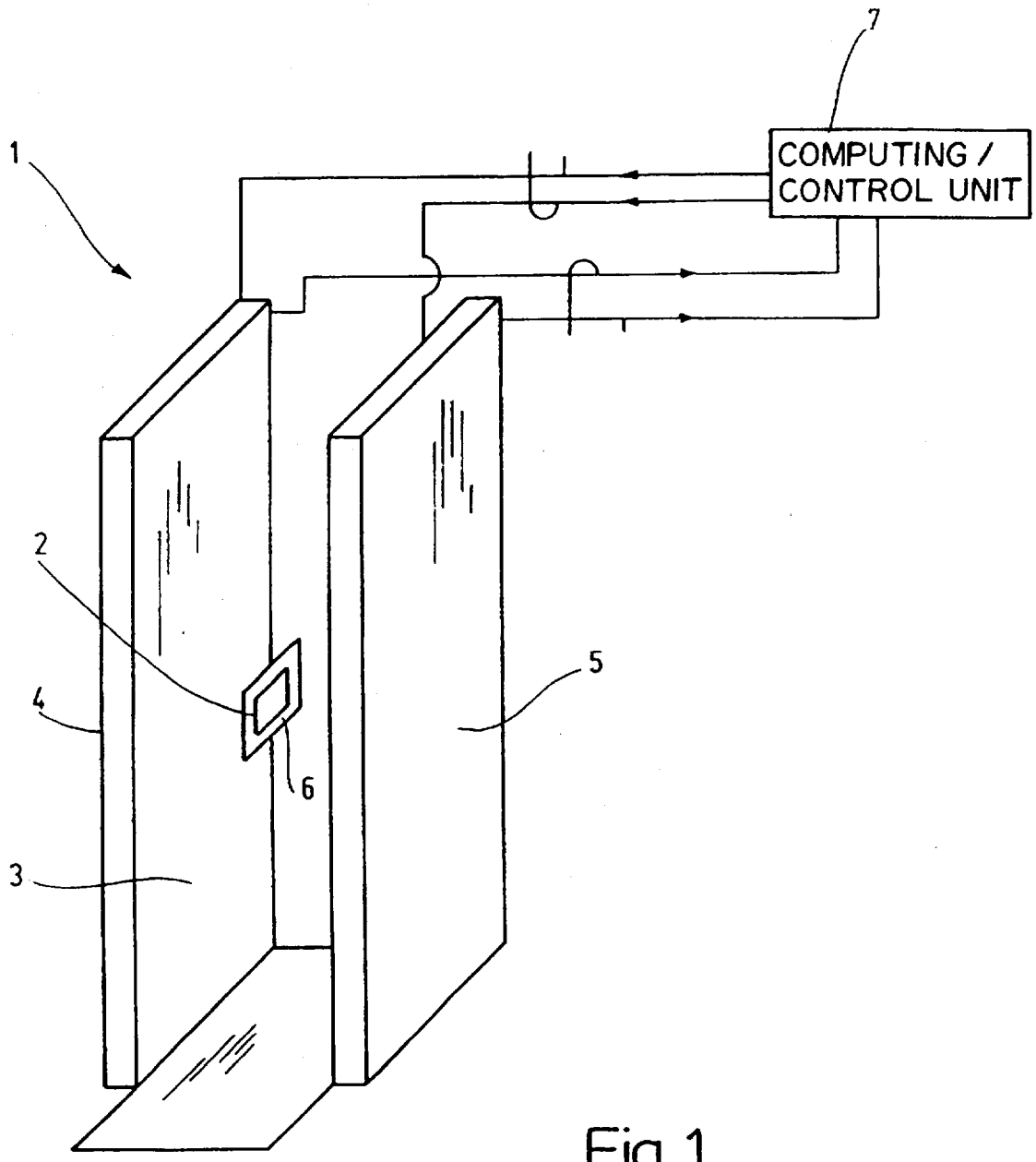
FIG. 1 is a schematic illustration of the apparatus of the present invention for detecting the presence of an article provided with a security element in an interrogation zone.

Referring now to FIG. 1, there is shown schematically the apparatus 1 of the present invention for detecting the presence of an article 6 provided with a security element 2 in an interrogation zone 3. The interrogation zone 3 is defined by two detector antennas disposed in substantially parallel arrangement and accommodating the transmitting device 4 and the receiving device 5. It will be understood, of course, that both devices 4, 5 may also be accommodated in one detector antenna. Control of the surveillance apparatus 1 and evaluation of the measured values are by means of the computing/control unit 7.

Figure 2:
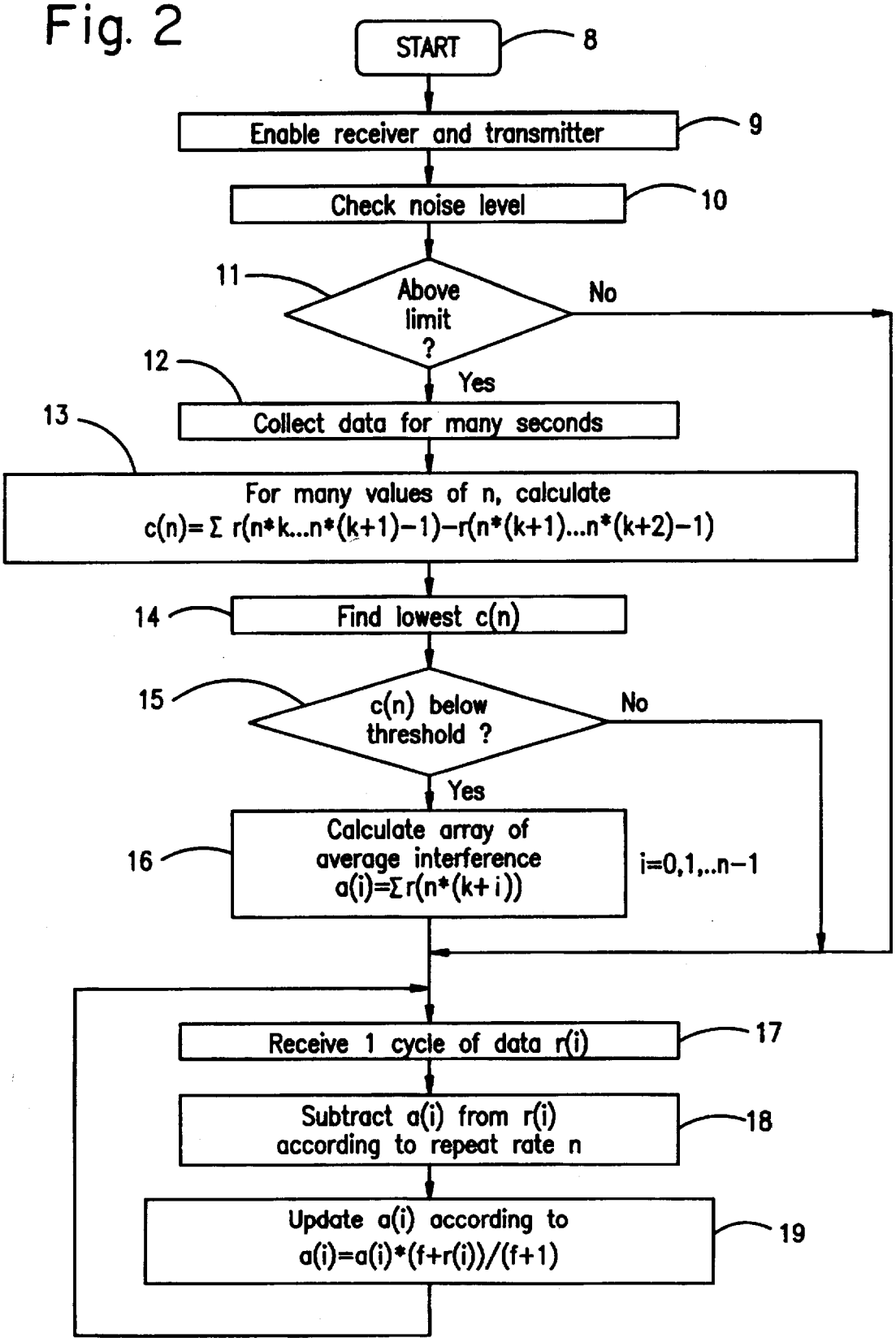
FIG. 2 is a flowchart of an advantageous program for controlling the apparatus of the present invention.

FIG. 2 shows a flowchart of an advantageous program for controlling the apparatus 1 of the present invention. Program start-up is at reference numeral 8. At 9, the transmitting device 4 and the receiving device 5 are activated. If the received signals r are below a predetermined noise level—this check being made at 11—the program proceeds to 17.

By contrast, if the received signals r are above the predetermined noise level, they are stored at 12 for a period of some time (several seconds, for example). The time period considered is conventionally a multiple of the cycle of the interrogation signal. At 13, the stored received signals r are split into k intervals of n measured values each, at least by approximation. Accordingly, k is an integer number smaller than or equal to the number of stored received signals r divided by n. Then the n measured values of the individual k groups are compared with each other applying the following formula:

$$c(n)=\Sigma|r(n*k \ldots n*(k+1)-1)-r(n*(k+1) \ldots n*(k+2)-1)|$$

Clearly this means that the n measured values within a first k interval are compared with the measured values of one of the succeeding k intervals. This makes it possible to establish whether in the intervals considered cyclic signal portions occur which are attributable to interference signals of known or unknown origin. Because intervals of different lengths are considered, the cycle of the interference signal is supplied by that particular value of n at which the minimum difference c(n) is determined. The computing/control unit 7 performs this test at 14.

At 15, a check is made to see whether the difference c(n) is below a predetermined proportion of the interference level. If the answer is no, the program proceeds to 17. If, however, the difference c(n) is above the predetermined value, the average interference signal a(i) in which the interference signal occurs is calculated at 16. This calculation is made according to the following formula:

$$a(i)=\Sigma r(n*(k+i)), \text{ where } i=1, 2, \ldots, n-1.$$

At 17, the received signals r are stored over one cycle of the interrogation signal. At 18, the interference signal a(i) is subtracted from the cyclic received signals r(i). This calculation must be made considering the repeat rate of the n measured values within one cycle of the cyclic interrogation signal. This is necessary to achieve synchronization between the received signals showing the cycle of the interrogation signal, and the cyclically occurring interference signals.

At 19, the computing/control unit 7 updates at a fixed time constant (f*cycle period) the information on occurring interference signals a(i). Following expiration of the predetermined time interval f, the program returns to 11, cycling in the meantime back to 17 to continually remove the average interference signal a(i) from the received signals r(i).

We claim:

1. An apparatus for surveillance of an electronic security element in an interrogation zone, comprising:

a transmitting device emitting at least one cyclic interrogation signal into the interrogation zone, the interrogation signal causing the security element to generate a characteristic signal;

a receiving device receiving the characteristic signal; and a computing/control unit connected to both said transmitting device and said receiving device for evaluating the signals received from said receiving device, said computing/control unit records at least k*n measured values during a predetermined period, wherein n=1, 2, 3 . . . z, and k is an integer number smaller than the number of received signals divided by n, determines whether cyclic interference signals occur within the time period encompassing n measured values from a comparison of n measured values of a first k interval with n measured values of succeeding k intervals, and produces an alarm when the presence of the security element is established.

2. The apparatus as claimed in claim 1, wherein the computing/control unit determines the absolute differences for different numbers of n measured values in k intervals by applying the following formula:

$$c(n)=\Sigma|r(n*k \ldots n*(k+1)-1)-r(n*(k+1) \ldots n*(k+2)-1)|.$$

3. The apparatus as claimed in claim 2, wherein the computing/control unit determines the cyclic interference signal from the lowest resulting difference $c_{min}$ (n), when the difference $c_{min}$ (n) is below a predetermined maximum difference value $c_{max}$.

4. The apparatus as claimed in claim 1, wherein the computing/control unit determines the cyclic interference signal from the lowest resulting difference $c_{min}$ (n), when the difference $c_{min}$ (n) is below a predetermined maximum difference value $c_{max}$.

5. The apparatus as claimed in claim 4, wherein the computing/control unit calculates the initial average interference signal a(i) in which an averaged interference signal occurs via the interval of n measured values using the following formula:

$$a(i)=\Sigma r(n*(k+i)), \text{ where } i=1, 2, \ldots, n-1.$$

6. The apparatus as claimed in claim 5, wherein the computing/control unit subtracts the averaged cyclically occurring interference signal (a(i)) from the received signals (r).

7. The apparatus as claimed in claim 1, wherein the computing/control unit performs an update on the determination of interference signals at a fixed time constant f*cycle period.

* * * * *